US007500718B2

(12) United States Patent
Fookes

(10) Patent No.: US 7,500,718 B2
(45) Date of Patent: Mar. 10, 2009

(54) TILT TENSION MECHANISM FOR CHAIR

(75) Inventor: Tim Fookes, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 157 days.

(21) Appl. No.: 11/130,039

(22) Filed: May 13, 2005

(65) Prior Publication Data

US 2005/0275269 A1 Dec. 15, 2005

Related U.S. Application Data

(60) Provisional application No. 60/571,231, filed on May 14, 2004.

(51) Int. Cl.
*A47C 1/024* (2006.01)
*A47C 1/032* (2006.01)

(52) U.S. Cl. ..... 297/303.3; 297/300.4; 297/302.3

(58) Field of Classification Search ..... 297/300.4, 297/301.3, 302.3, 303.3; 74/424.5
See application file for complete search history.

(56) References Cited

U.S. PATENT DOCUMENTS

| | | | | |
|---|---|---|---|---|
| 181,575 | A | | 8/1876 | Hayes |
| 2,049,550 | A | | 8/1936 | Van Dresser et al. |
| 2,211,090 | A | | 8/1940 | Bolens et al. |
| 2,286,468 | A | | 6/1942 | Cramer et al. |
| 2,341,124 | A | | 2/1944 | Sheldrick |
| 2,354,736 | A | | 8/1944 | Boerner |
| 2,398,072 | A | | 4/1946 | Boerner |
| 2,420,745 | A | | 5/1947 | Harman |
| 2,441,251 | A | | 5/1948 | Raitch |
| 2,441,727 | A | * | 5/1948 | Snow ..... 74/16 |
| 2,456,797 | A | | 12/1948 | Sheldrick |
| 2,648,910 | A | | 8/1953 | Brown |
| 2,667,209 | A | | 1/1954 | Gundersen |
| 2,889,868 | A | | 6/1959 | Seenberg |
| 2,935,885 | A | * | 5/1960 | Saari ..... 74/425 |
| 3,059,890 | A | | 10/1962 | Radke et al. |
| 3,224,290 | A | * | 12/1965 | Polydoris ..... 74/424.5 |
| 3,269,204 | A | * | 8/1966 | Schleicher, Jr. ..... 74/424.5 |
| 4,494,795 | A | * | 1/1985 | Roossien et al. ..... 297/362.14 |
| 4,652,050 | A | * | 3/1987 | Stevens ..... 297/303.4 |
| 4,666,121 | A | | 5/1987 | Choong et al. |
| 4,709,963 | A | * | 12/1987 | Uecker et al. ..... 297/300.5 |
| 4,818,019 | A | | 4/1989 | Mrotz, III |
| 5,209,548 | A | * | 5/1993 | Locher ..... 297/300.4 |
| 5,224,758 | A | | 7/1993 | Takamatsu et al. |

(Continued)

OTHER PUBLICATIONS

Dudley's Gear Handbook; Dennis P. Townsend; Second Edition, 1991; pp. 2-5, 2.14-2.17, 2.22-2.27.*

(Continued)

*Primary Examiner*—David Dunn
*Assistant Examiner*—Tania Abraham
(74) *Attorney, Agent, or Firm*—Flynn, Thiel, Boutell & Tanis, P.C.

(57) ABSTRACT

A tilt tension mechanism for a chair comprises a gear drive mechanism for driving a torsion bar having a drive shaft, a face gear and an actuator shaft with a pinion gear section. The pinion gear section and face gear have cooperating spiral threads which provide for multi-teeth engagement. An isolator bearing is disposed adjacent to the engagement section between said pinion gear teeth and said face gear teeth to support vertical tooth loads.

24 Claims, 13 Drawing Sheets

U.S. PATENT DOCUMENTS 5,603,552 A * 2/1997 Hanna et al. ..... 297/473
5,718,476 A * 2/1998 De Pascal et al. ..... 297/284.4
5,772,282 A 6/1998 Stumpf et al.
6,086,153 A * 7/2000 Heidmann et al. ..... 297/300.1
6,382,724 B1 * 5/2002 Piretti ..... 297/302.3
6,705,677 B2 * 3/2004 Oshima et al. ..... 297/300.2
6,793,284 B1 * 9/2004 Johnson et al. ..... 297/302.3
6,945,603 B2 * 9/2005 Elzenbeck ..... 297/303.4

OTHER PUBLICATIONS

Disclosure document for Comforto System 25 chair control mechanism sold publicly since about the mid 1980's (1 page).

* cited by examiner

TILT TENSION MECHANISM FOR CHAIR

CROSS REFERENCE TO RELATED APPLICATION

This application claims the benefit of U.S. Provisional Application No. 60/571,231, filed May 14, 2004.

FIELD OF THE INVENTION

This invention relates to an office-type chair, and more specifically relates to a synchrotilt mechanism having an improved tilt tension mechanism coupled to the seat and back of the chair.

BACKGROUND OF THE INVENTION

Office chairs conventionally provide some type of rearward tilting movement. In its simplest variations, the rear tilting involves solely the back, or the seat and back as a unitary construction. To provide improved and more desirable tilting movement and seating comfort, however, many office-type chairs employ a synchrotilt mechanism coupled between the chair base and the seat-back assembly, for permitting the seat and back to simultaneously tilt at different rates, with the tilt rate and maximum tilt angle of the back typically being about twice the tilt rate and maximum tilt angle of the seat.

Chairs employing synchrotilt mechanisms for permitting simultaneous but relative tilting of the seat and back are well known, and numerous mechanisms have been developed for performing this function. Additionally, such synchrotilt mechanisms include a subassembly, namely a tilt tension mechanism that includes a resilient biasing arrangement which permits rearward tilting or reclining of the seat and back while generating a resilient restoring force to bias the seat and/or back upwardly or forwardly to a normal, unreclined position. Known biasing arrangements typically include a spring mechanism such as a coil spring or torsion bar which provide the resilient restoring force.

For those types of chairs having a torsion bar, such torsion bars typically include an arm projecting radially therefrom which is swingable circumferentially about an elongate axis of the torsion bar. This drive arm controls the deflection within the torsion bar, and as such, the amount of displacement of the drive arm controls the restoring force. Known chair arms have used various drive mechanisms for displacing the drive arm pursuant to a manual actuator that is controlled by the chair occupant.

For example, U.S. Pat. No. 5,772,282 (Stumpf et al.) discloses a driving arrangement having a upwardly extending threaded drive shaft which is rotatably mounted to a control body of the tilt tension mechanism. A block member engaged with the distal end of the radial arm of a torsion spring moves up and down the threaded shaft in response to rotation thereof. The mechanism of the '282 patent includes a bevel gear on the upper end thereof which cooperates with a cooperating bevel gear that meshes therewith and is driven by a rotatable handle.

The invention relates to a chair having an improved drive mechanism for driving the drive arm of a torsion bar by manual rotation of an actuator handle. The tilt tension mechanism of the invention includes a threaded drive shaft rotatably mounted on the control body of the tilt tension mechanism and a follower nut which rides vertically along the drive shaft in response to shaft rotation.

To drive the shaft, an improved gear drive arrangement is provided comprising a drive gear and a sidewardly-oriented actuator shaft having a pinion section with spiral threads thereon which mate with corresponding spiral gear teeth on the face of the drive gear. Rotation of the actuator shaft effects rotation of the drive gear, and the gear and pinion have a spiral teeth arrangement to provide continuous engagement between multiple teeth in an effort to reduce tooth stress and loading, reduce backlash and improve the overall operation of the gear drive.

Other objects and purposes of the invention will be apparent to persons familiar with constructions of this general type upon reading the following specification and inspecting the accompanying drawings.

Figure 1:
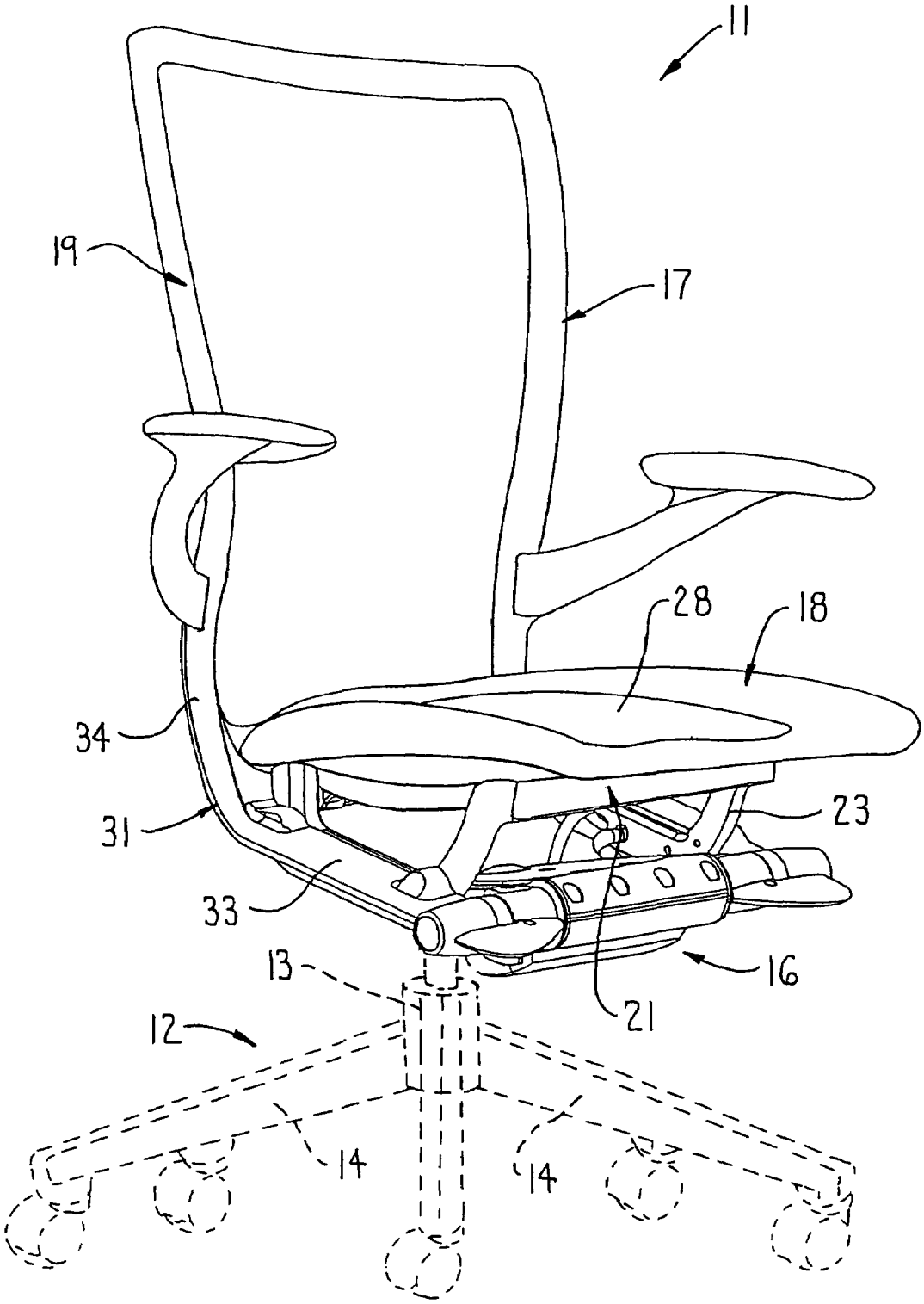
FIG. 1 is a perspective view of an office-type chair employing the improved tilt tension mechanism of the present invention.

Certain terminology will be used in the following description for convenience in reference only, and will not be limiting. For example, the words "upwardly", "downwardly", "rightwardly" and "leftwardly" will refer to directions in the drawings to which reference is made. These latter terms will also refer to the normal directions and positional orientations associated with a person sitting in the chair. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Referring to FIG. 1, there is illustrated a chair 11 which incorporates therein a synchrotilt control having an improved tilt tension arrangement according to the present invention. The chair 11 includes a base 12 provided with a plurality of legs 14 which radiate outwardly and are provided with casters for rolling support on a floor. The base 12, centrally thereof, has a height-adjustable pedestal 13 which projects upwardly and, at the upper end thereof, couples to a chair control 16, the latter in turn providing support for an L-shaped seat-back arrangement 17 which includes a seat assembly 18 and a back assembly 19.

The seat assembly 18 includes a rigid seat frame or cradle 21 defined by a generally rectangular ring-shaped top frame 22 (FIG. 2) which, adjacent opposite sides, is provided with generally parallel side frame elements 23. The elements 23 are generally U-shaped and protrude downwardly, with upper ends of the projecting portions being rigidly joined adjacent the front and rear corners of the top frame 22.

The seat assembly 18 defines thereon an upper seat cushion 28 disposed for contacting engagement with a chair occupant. The seat cushion 28, when engaged with a seated occupant, resiliently deforms downwardly so that the upper surface thereof, at least in the main central region of the cushion 28 where engaged with the occupant, is deflected downwardly from the non-deformed position indicated in FIG. 1.

The back assembly 19 is supported on a generally rigid upright structure 31 which is defined by a pair of generally parallel and sidewardly positioned L-shaped side upright elements or members 32, each of which has a lower lever arm portion 33 positioned below the seat cushion 28 and which, at a rearward end, is joined through an integral bend to an upper arm portion 34 which is cantilevered upwardly and has the back assembly 19 mounted thereon. The sidewardly spaced uprights 32 are, adjacent the lower ends of the upper arm portions 34, rigidly joined by a cross member 35 extending therebetween.

The forward ends of the lower lever arm portions 33 are nonrotatably connected to a tilt shaft 42 which defines a rotational axis 43 extending generally horizontally in transverse relationship relative to the seat assembly 18. The tilt shaft 42 is rotatably supported within a housing or support arm 41 which is fixed to the upper end of the height-adjusting pedestal 13, with the housing 41 being cantilevered forwardly from the pedestal so that the tilt shaft 42 is positioned under but more closely adjacent the front edge of the seat surface.

Figure 5:
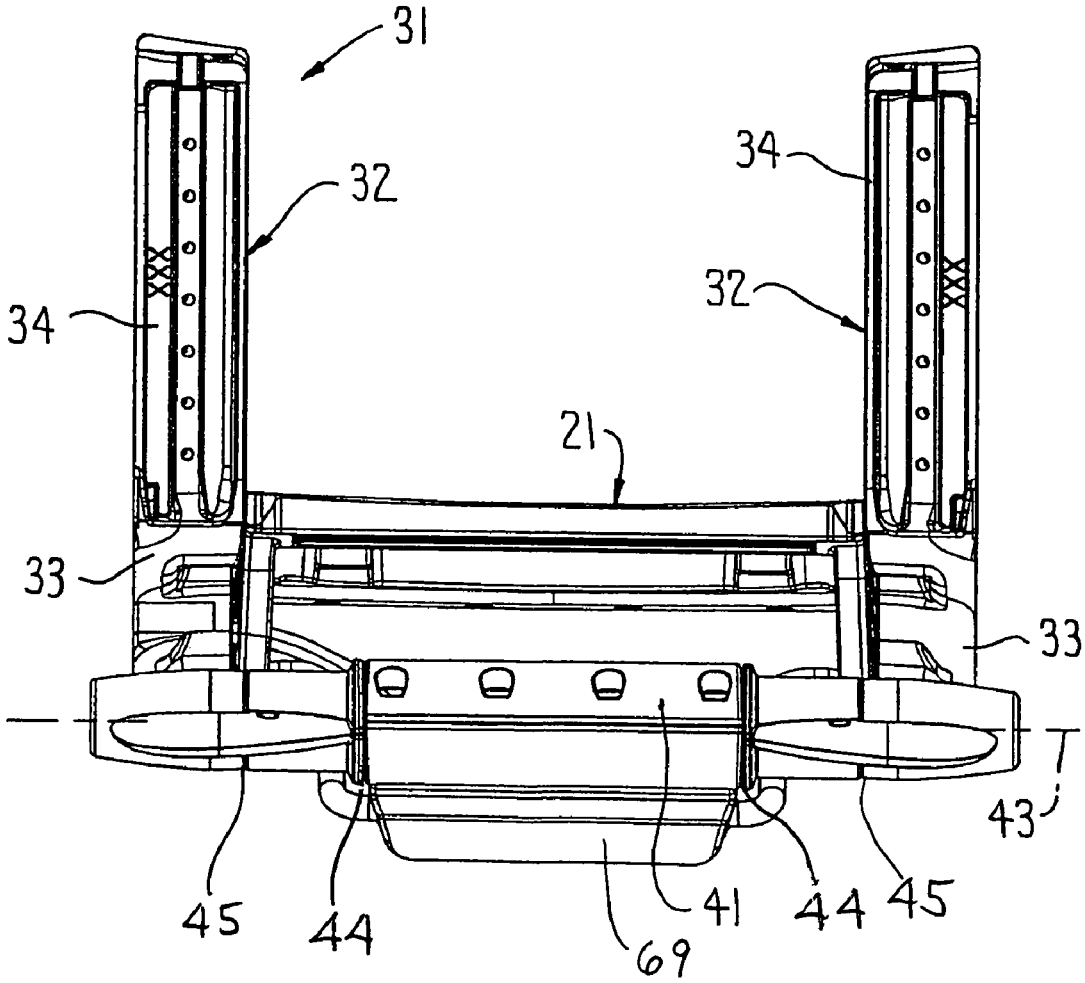
FIG. 5 is a front view of the assembly shown in FIG. 3.

The tilt shaft 42 projects outwardly through openings 44 (FIGS. 5 and 6) formed in opposite sides of the housing 41 so that opposite end portions of the tilt shaft 42 are disposed on opposite sides of the housing 41. The projecting end portions of the shaft 42 in turn project through openings 45 associated with the forward ends of the lower lever arm portions 33, with these latter arm portions being nonrotatably secured to the shaft 42 as discussed in further detail herein, whereby the rigid upright arrangement 31 is angularly movable about the horizontal axis 43 in correspondence with angular displacement of the tilt shaft 42.

Figure 6:
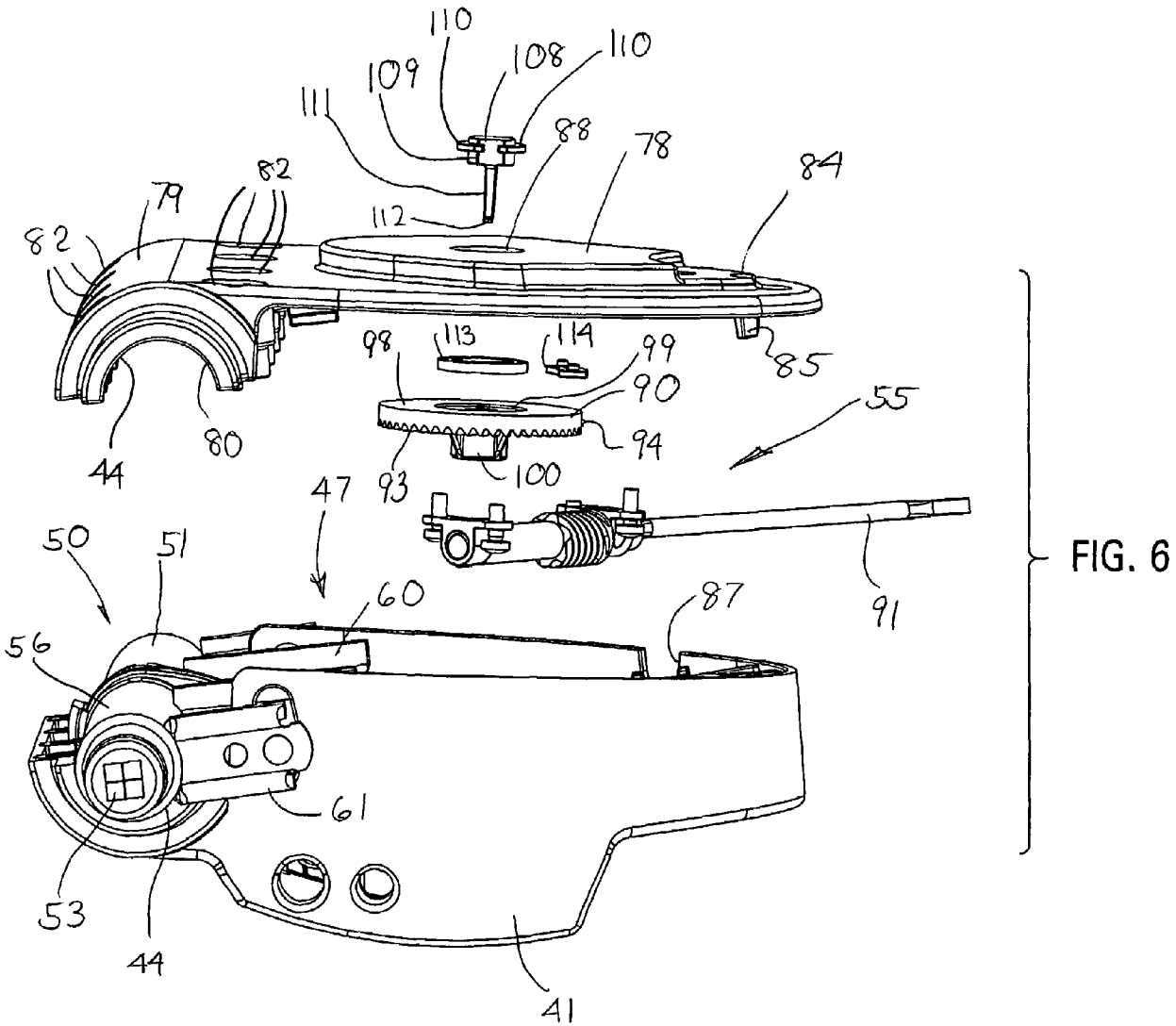
FIG. 6 is an exploded side elevational view of the tilt tension mechanism.
Figure 7:
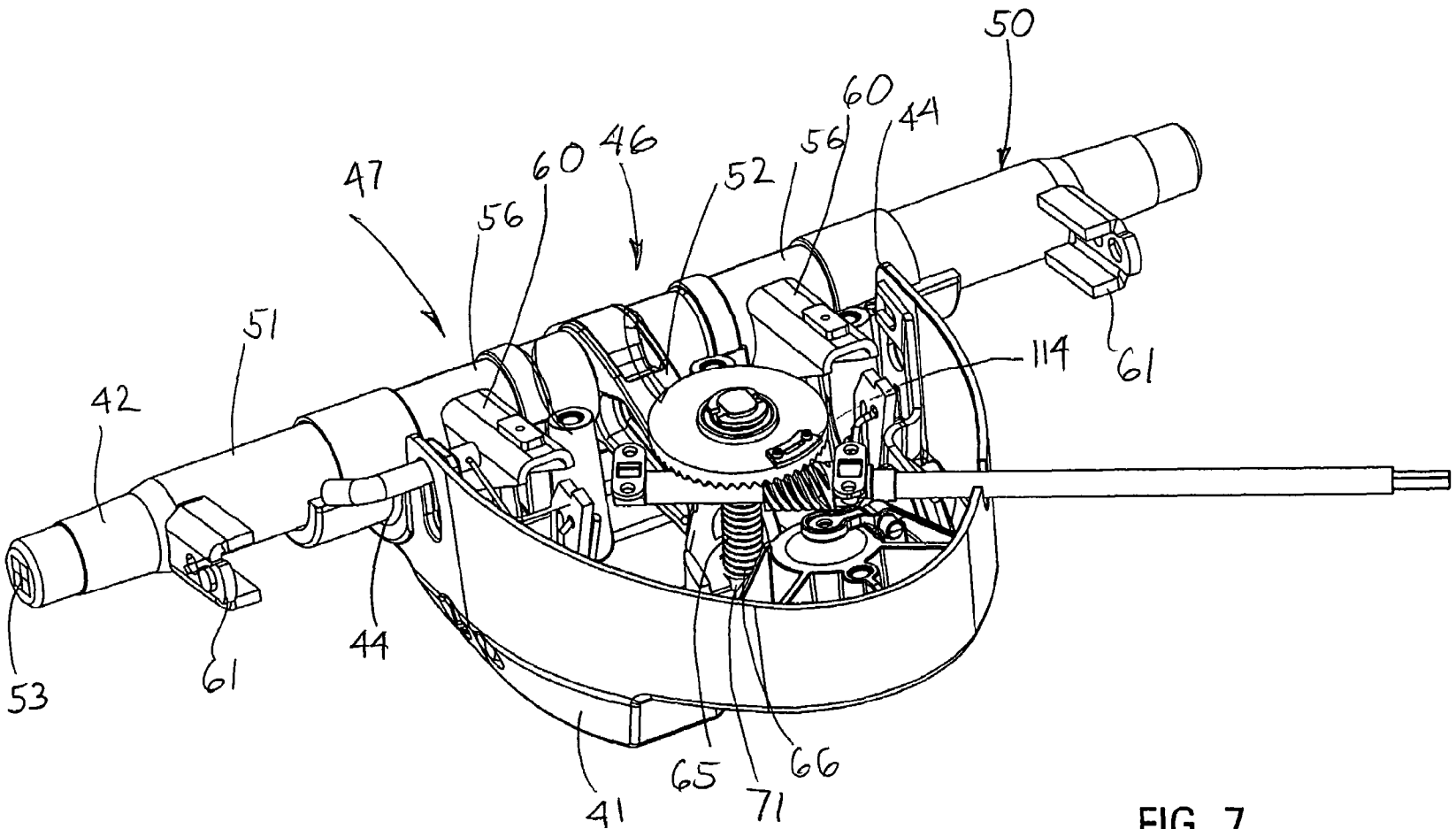
FIG. 7 is a rear perspective view of the tilt tension mechanism as viewed from above with a cover plate removed.
Figure 8:
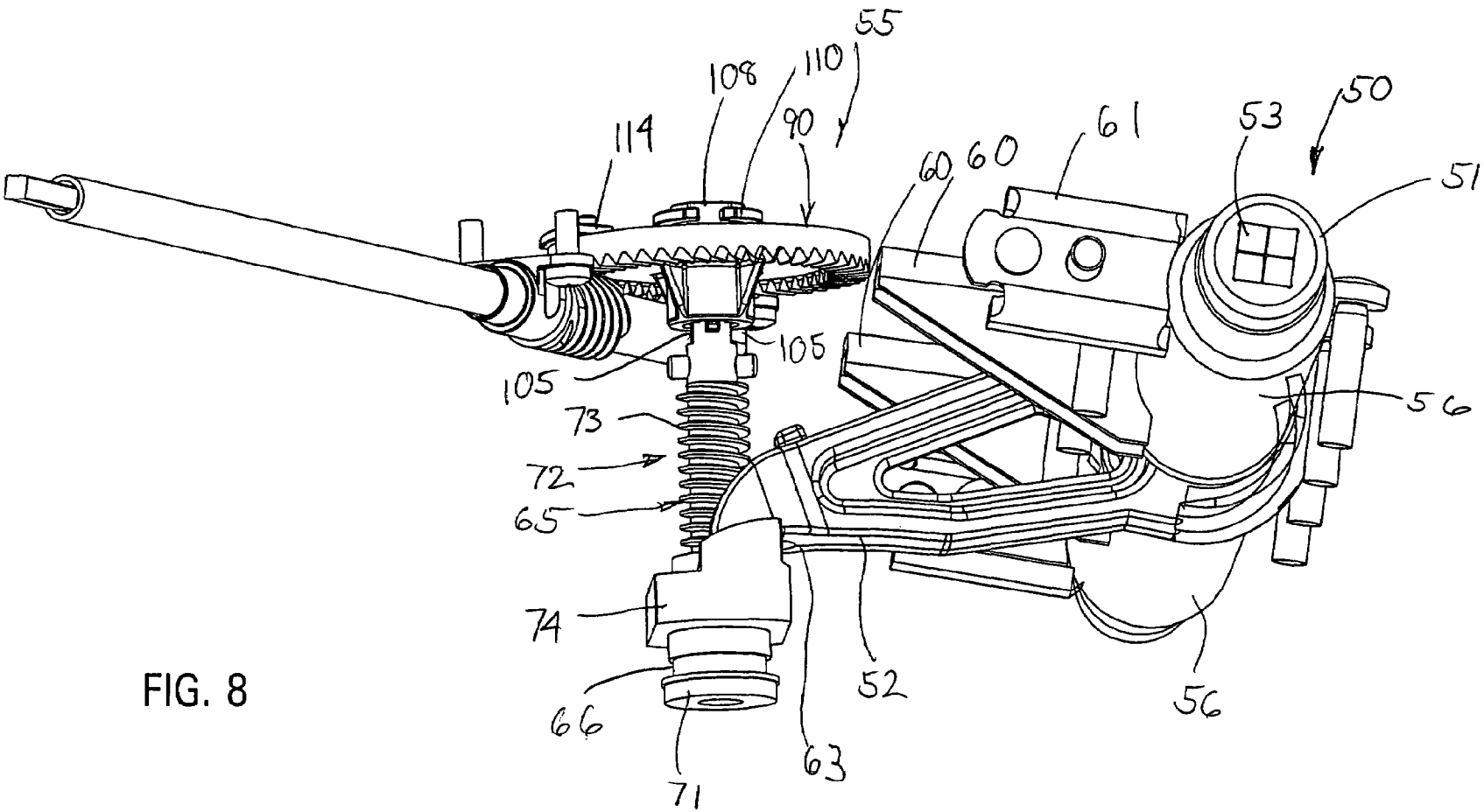
FIG. 8 is a lower, right side perspective view of the internal components of the tilt tension mechanism including a spiral gear drive arrangement.
Figure 9:
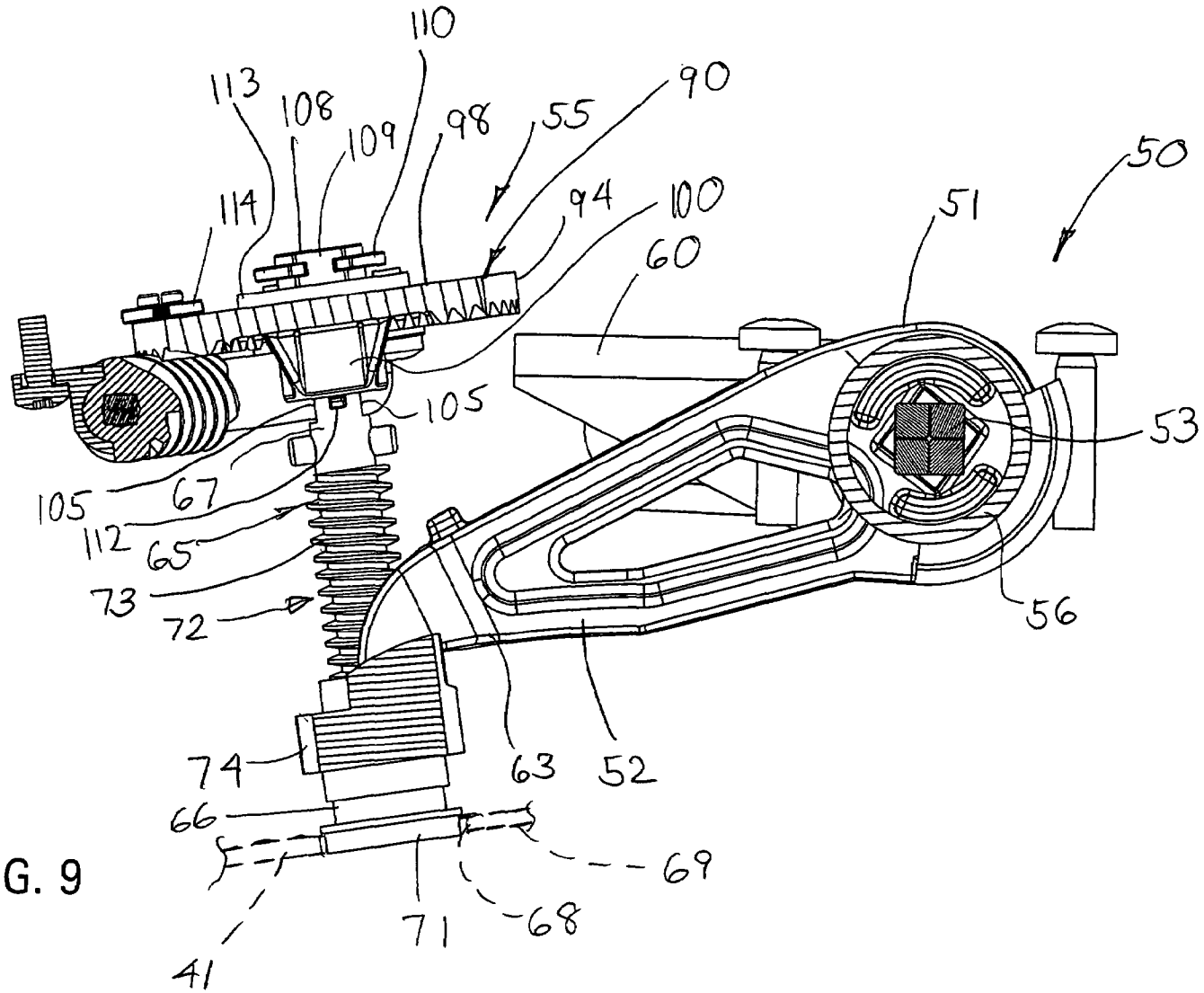
FIG. 9 is a side cross-sectional view of the mechanism of FIG. 8 as taken along line 9-9 of FIG. 11.

Referring to FIGS. 6 and 7, the housing 41 functions as an enclosure for an improved biasing or spring mechanism 46 for normally urging the back assembly 19 into an upright position. In the present invention, and as illustrated in FIGS. 6-12, the chair employs the biasing or spring mechanism 46 which is disposed within the interior 47 of the control housing 41 and includes a biasing or spring device 50, namely an elongate torsion bar 51 in the illustrated embodiment. This torsion bar 51 has a radial drive arm 52 anchored thereto substantially at the center of the torsion bar, which arm 52 at its other end is interconnected to the control housing 41, typically through a manually-adjustable gear drive mechanism 55 which permits limited upward swinging of the arm 52 so as to adjust the initial torsion or restoring force of the torsion bar 51 and the maximum restoring force generated during tilting of the chair.

This torsion bar 51, as it projects outwardly from opposite sides of the drive arm 52, has an interior bar 53 telescoped within the interior of coaxially aligned shaft segments 56 which define the main tilt shaft 42, wherein the bar 53 is resiliently connected to the shaft segments 56 to permit relative rotation between the shaft segments 56 and the bar 53 with the resilient restoring force resisting this relative rotation.

The shaft segments also have radially-projecting stop members or projections 60 fixed thereto and cooperating with opposed stops (not shown) associated with the control housing 41 for defining the permissible angle of movement of the shaft 42 and of the back arrangement 19 as coupled thereto through the upright structure 31. The shaft segments 56 further include radially-projecting connector brackets 61 disposed outside of the control housing 41 which connect to the forward ends of the lower lever arm portions 33 such that rearward tilting of the back assembly 19 effects rotation of the shaft segments 56 relative to the interior bar 53 resiliently connected thereto. Thus, the resilient restoring force of the torsion bar 51 applies the restoring force to the upright structure 31 to resist rearward tilting or reclining of the back assembly 19 and return the back assembly to the initial unreclined position generally illustrated in FIGS. 1-3.

To adjust the magnitude of the restoring force, the gear drive mechanism 55 is connected to the outer, free end 63 of the radial drive arm 52. By displacing the drive arm 52 upwardly or downwardly, the relative position of the interior bar 53 relative to the shaft segments 56 is adjusted which thereby adjusts the restoring force in direct relation to the resiliency of the resilient connection between the bar 53 and the shaft segments 56. The gear drive mechanism 55 generally is manually actuatable by the chair occupant to effect this adjustment of the drive arm 52.

More particularly as to the gear drive mechanism 55, this mechanism includes a main upright drive shaft 65 having a lower end 66 rotatably connected to the control housing 41 and an upper end 67 projecting upwardly therefrom. Referring to FIG. 7, the lower shaft end 66 projects downwardly through an opening 68 (FIGS. 4 and 9) formed in the bottom wall 69 of the control housing 41 by a thrust washer 71 so that the drive shaft 65 is rotatably supported on the control housing 41 with vertical shaft loads being supported by the bottom housing wall 69.

The drive shaft 65 projects vertically and includes a threaded section 72 with circumferential threads that extends along a substantial intermediate portion of the shaft length. The threaded section 72 has a block-like follower nut 74 which is formed with an internal threaded bore that is threadedly engaged with the threads 73 of the threaded section 72. The follower nut 74 travels upwardly and downwardly along the threaded section 72 in response to controlled rotation of the drive shaft 65.

Figure 11:
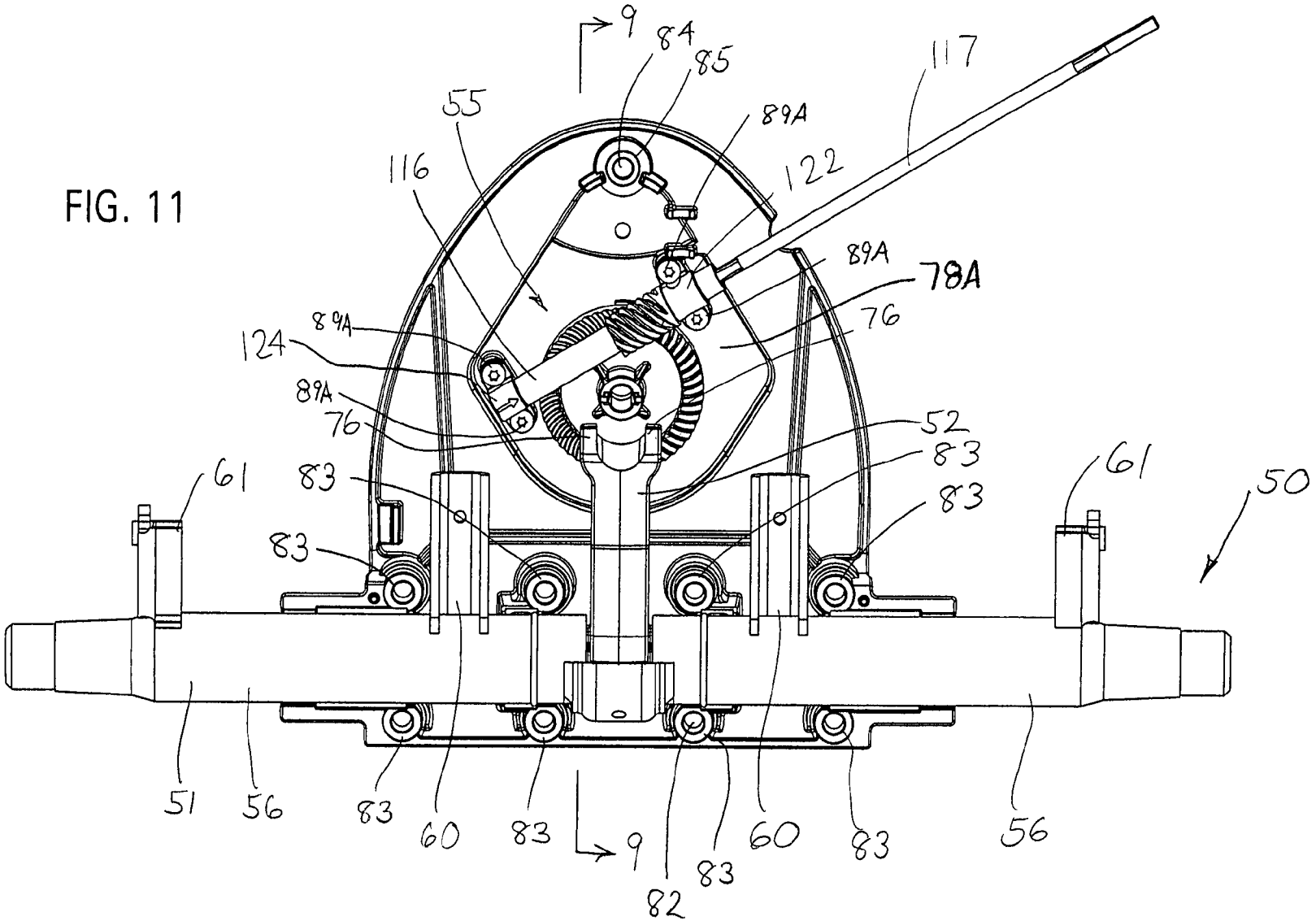
FIG. 11 is a bottom view of the tilt tension mechanism and the top plate.

Referring to FIG. 11, the drive arm 52 includes a yoke-like arrangement comprising a pair of sidewardly spaced apart legs 76 which project rearwardly and rest downwardly on the upper surface of the follower nut 74 such that the drive arm 52 travels vertically in unison with the follower nut 74. Therefore, once the torsion bar 51 is mounted in place, the torsion bar 51 and the drive shaft 65 are supported by the control housing 41.

As to the control housing 41, this housing further includes a top plate 78 which is rigidly affixed to and overlies the open interior 47 of the control housing 41. The top plate 78 includes a downwardly-curving arcuate front portion 79 which is adapted to fit over the torsion bar 51 and secure the torsion bar 51 in position. The top plate 79 includes semi-circular side portions 80 in the sides thereof which define the upper halves of the openings 44 wherein the opposite ends of the torsion bar 51 project outwardly therefrom.

Figure 10:
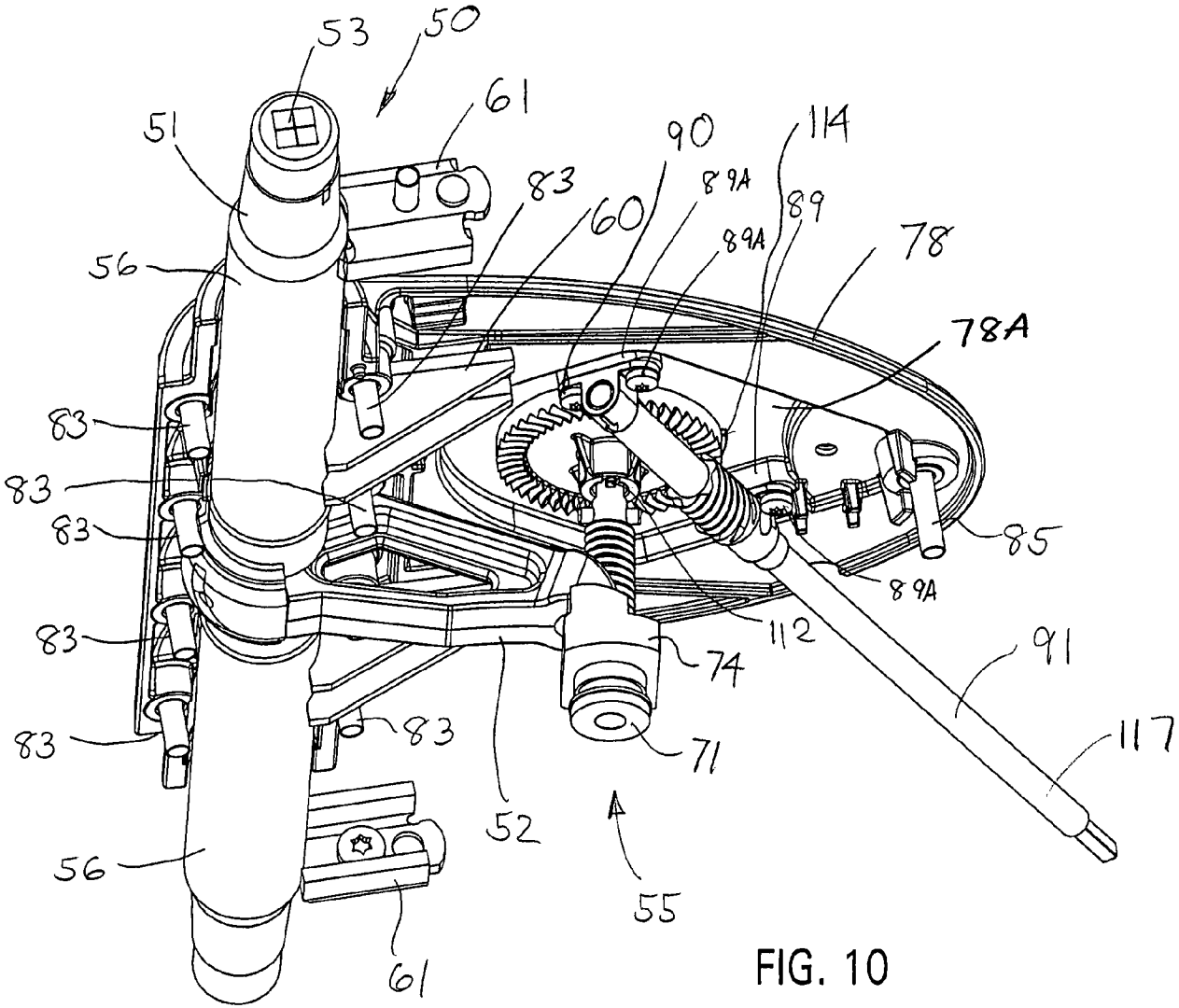
FIG. 10 is a lower left side perspective view of the tilt tension mechanism with the top plate illustrated therewith.

The front portion 79 as illustrated in FIGS. 6, 10 and 11 includes two rows of fastener bores 82 which open downwardly and communicate with coaxially aligned fastener cylinders 83. These cylinders 83 mate with corresponding bores in the control housing 41 and allow the top plate 78 to be fastened to the control housing 41 by suitable fasteners such as threaded screws. Additionally, the top plate 78 also includes a similar fastener bore 84 and an aligned fastener cylinder 85 at the back plate edge thereof which allow an additional fastener to be screwed through and into fixed engagement with the back end of the control housing 41. Therefore, the top plate 78 is rigidly mountable to the control housing 41 but also is removable therefrom.

To accommodate the gear drive mechanism 55, the side wall of the control housing 41 includes an actuator shaft notch 87, while the top plate 78 includes a circular opening 88. Still further, the top plate 78 has downwardly projecting connector blocks 89 which are each adapted to engage a pair of fasteners 89A as generally illustrated in FIG. 10 and as discussed in further detail hereinafter.

Referring more particularly to the gear drive mechanism 55, this mechanism generally comprises a face-type, drive gear 90 and an actuator shaft 91 which shaft 91 extends sidewardly and is rotated manually to effect driving rotation of the face gear 90. The gear 90 further is coupled to and rotatably drives the drive shaft 65 to effect adjustment of the torsion bar 51.

More particularly, the gear 90 as illustrated in FIGS. 12-16 has a primary gear face 92 which normally faces downwardly and includes an annular pattern of gear teeth 93 formed about the outer circumference 94 of the gear 90. The gear teeth 93 project downwardly in a direction generally perpendicular to the primary gear face 92 and parallel to the axis of the gear 90 and shaft 65. Individually, the gear teeth 93 have a spiral pattern in the radial direction with the outer tooth end 95 of each gear tooth being circumferentially offset in the counterclockwise direction from the inner end 96 of the respective gear tooth. The gear teeth 93 further change in thickness from the head to the toe thereof. The gear 90 further includes a bearing face 98 opposite to the gear face 92 which is formed with a recessed bearing seat 99 at the center thereof.

Additionally, the gear 90 includes a mounting hub 100 which projects from the primary gear face 92 and includes a circular outer circumference 101. A central opening 102 extends vertically through the entire thickness of the gear 90 including the mounting hub 100 to permit engagement with the drive shaft 65. More particularly, the central opening 102 includes arcuate portions 103 which essentially define opposite sides of a circle which said circle has a diameter slightly larger than the outer diameter of the upper end 67 of the drive shaft 65 so as to snugly receive the drive shaft 65 therein. As such, the upper shaft end 67 slidably fits within the central opening or passage 102.

To define a non-rotatable connection between the drive shaft 65 and the mounting hub 100, the central opening 102 includes flat lands 104 which flat lands are adapted to abut against a pair of flats 105 (FIG. 9) on the upper shaft end 67 such that the drive shaft 65 in effect has a keyed shape which corresponds to a keyed shape of the central opening 102.

Additionally to secure the gear 90 to the top plate 78, the mounting hub 100 also includes squared vertical channels 106 which extend vertically along the length of the opening 102 and open interiorly or sidewardly into the opening 102. A channel 106 is located between each pair of flat lands 104.

The gear 90 is rotatably mounted to the top plate 78 by a plastic isolator bushing 108 (FIG. 6). The isolator bushing 108 includes an enlarged rotation hub 109 which rotatably fits within the plate opening 88 which hub portion 109 further includes radially projecting circumferential stop ribs 110 which rest on the top surface of the top plate 78 and slide circumferentially therealong during rotation of the gear 90.

The hub portion 109 also includes a pair of cantilevered, resiliently flexible connector fingers 111 which project downwardly away from the opening 88 and are received axially within the channels 106 of the gear 90. The lowermost ends of the connector fingers 111 include radial projections 112 (FIGS. 6 and 10) which project axially out of the central gear opening 102 and abut against the bottom surface of the gear mounting hub 100 such that the gear 90 is rotatably supported on the top plate 78 by the isolator bushing 108. This isolator bushing 108 and specifically, the connector fingers 111 thereof serve to interconnect the gear 90 and the top plate 78 together in a removable assembly.

Since the gear 90 rotates relative to the top plate 78, a low-friction thrust washer 113 is supported within the gear recess 99 so as to be sandwiched between the bearing face 98 and the opposing lower surface 78A of the top plate 78.

Additionally, an arcuate, plate-like isolator bearing 114 also is positioned or sandwiched between the bearing face 98 and the opposing surface 78A of the top plate 78 near the outer gear circumference 94. The isolator bearing 114 is located in the right rear quadrant of the gear 90. This isolator bearing 114 is located directly below the engagement location between the gear 90 and the actuator shaft 91 as will be discussed in further detail herein to thereby provide low-friction, vertical support to the bearing face 98 and help maintain the outer circumference of the gear 90 in engagement with the actuator shaft 91. The bearing 114 is made of a suitable low-friction material.

When the top plate 78 is mounted in position on the control body 41, the gear mounting hub 100 slips downwardly onto the upper end 67 of the drive shaft 65 wherein rotation of the gear 90 effects a corresponding rotation of this drive shaft 65. However, since the top plate 78 is fixed to the control body 41, it is not necessary to permanently fasten the gear 90 to the shaft 65 wherein the gear 90 therefore is removable in unison with the top plate 78.

Figure 2:
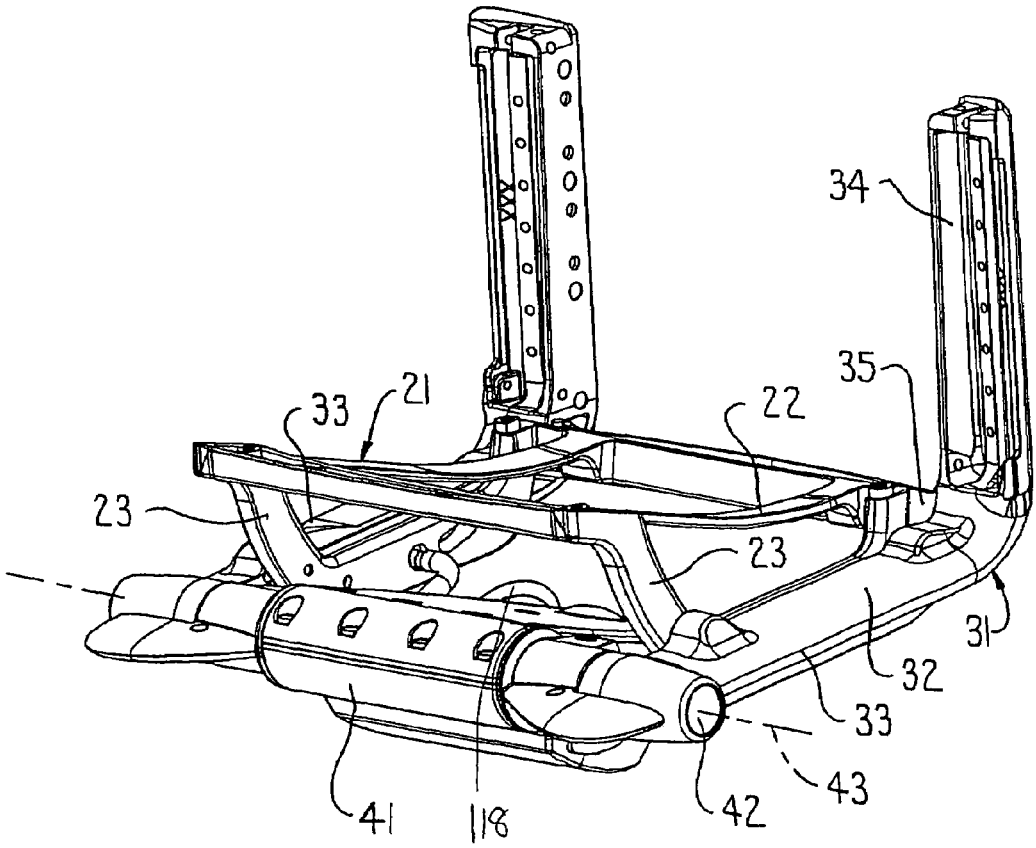
FIG. 2 is a perspective view showing a seat cradle assembled to an upright structure and additionally showing the connection to the chair control housing of the tilt tension mechanism.
Figure 3:
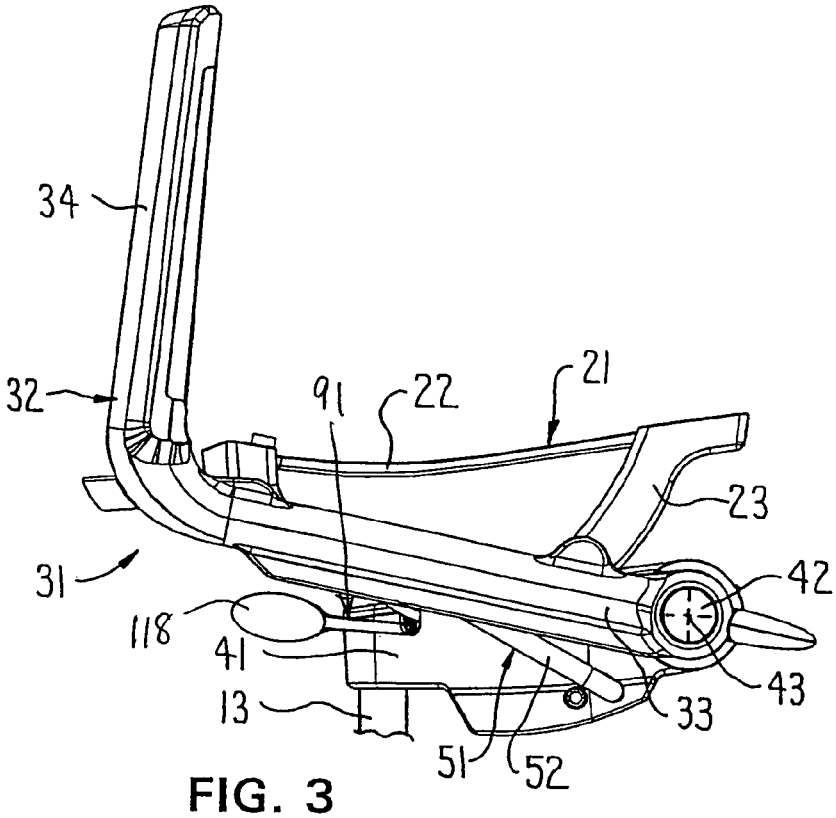
FIG. 3 is a side elevational view of the assembly shown in FIG. 2.
Figure 4:
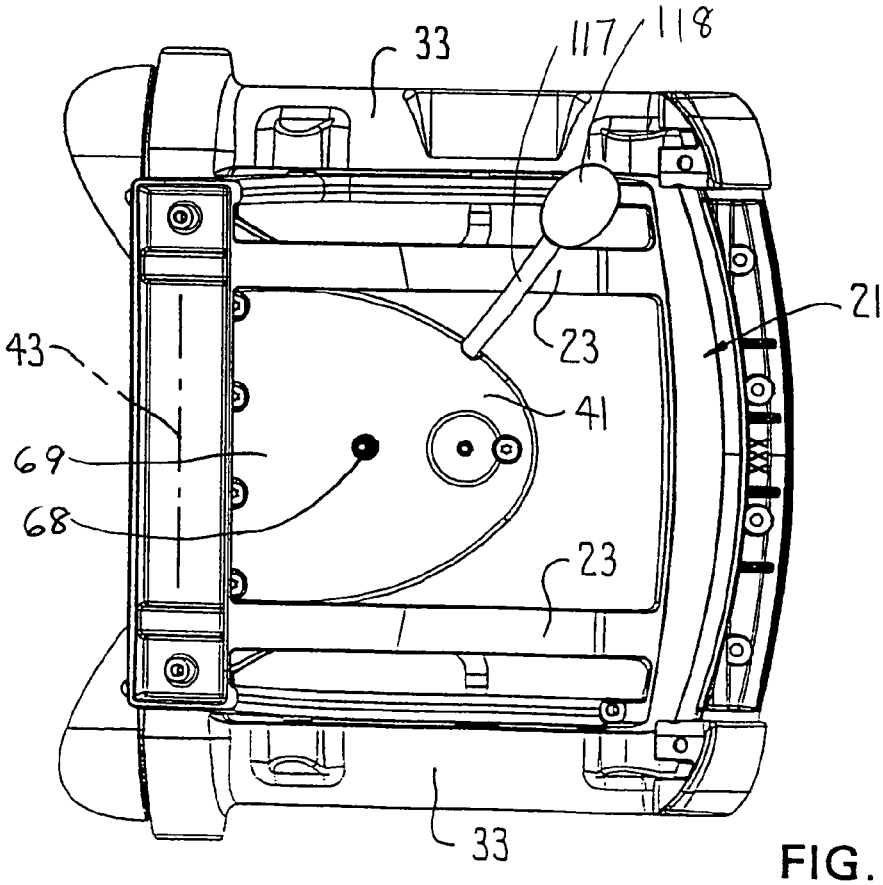
FIG. 4 is a top view of the assembly shown in FIG. 3.

More particularly as to the actuator shaft 91, this actuator shaft 91 also is mounted to the top plate 78 as illustrated in FIG. 10 so as to be movable in unison therewith. Referring to FIG. 11, the actuator shaft 91 is formed by an inner pinion gear section 116 which connects to an elongate outer rod 117, the outer end of which connects to a manual actuator knob 118 (FIGS. 2-4). The gear section 116 as illustrated in FIGS. 11 and 17-20 comprises a tubular outer end section 119 which has a blind bore 120 into which is fixedly connected the adjacent end of the rod 117. As such, the rod 117 and gear section 116 form a joined assembly wherein rotation of the hand knob 118 by a chair occupant effects rotation of the gear section 116.

The outer circumference 121 effectively defines an axle by which the gear section 116 may be rotatably supported on the top plate. In this regard, a generally U-shaped clamp bracket 122 fits over the outer gear end 119 and is fixed to one of the connector blocks 89 of the top plate 78 by a pair of the above-described fasteners 89A.

The gear section 116 further includes a reduced diameter section 123 which defines an additional axle section that is rotatably mounted on the top plate 78 by a further clamp bracket 124 which said clamp bracket 124 is affixed to the other connector block 89 by a respective pair of the fasteners 89A. The annular shaft wall 125 defining the side of the reduced diameter portion 123 effectively defines a stop that abuts against an adjacent edge of the clamp bracket 124 and prevents inward movement of the actuator shaft 91.

The gear section 116 also includes a threaded section 126 which has an increased diameter relative to the outer section end 119 to effectively define an additional stop surface 127 that faces axially and abuts against the adjacent clamp bracket 122 to prevent inward displacement of the shaft 91.

Figure 12:
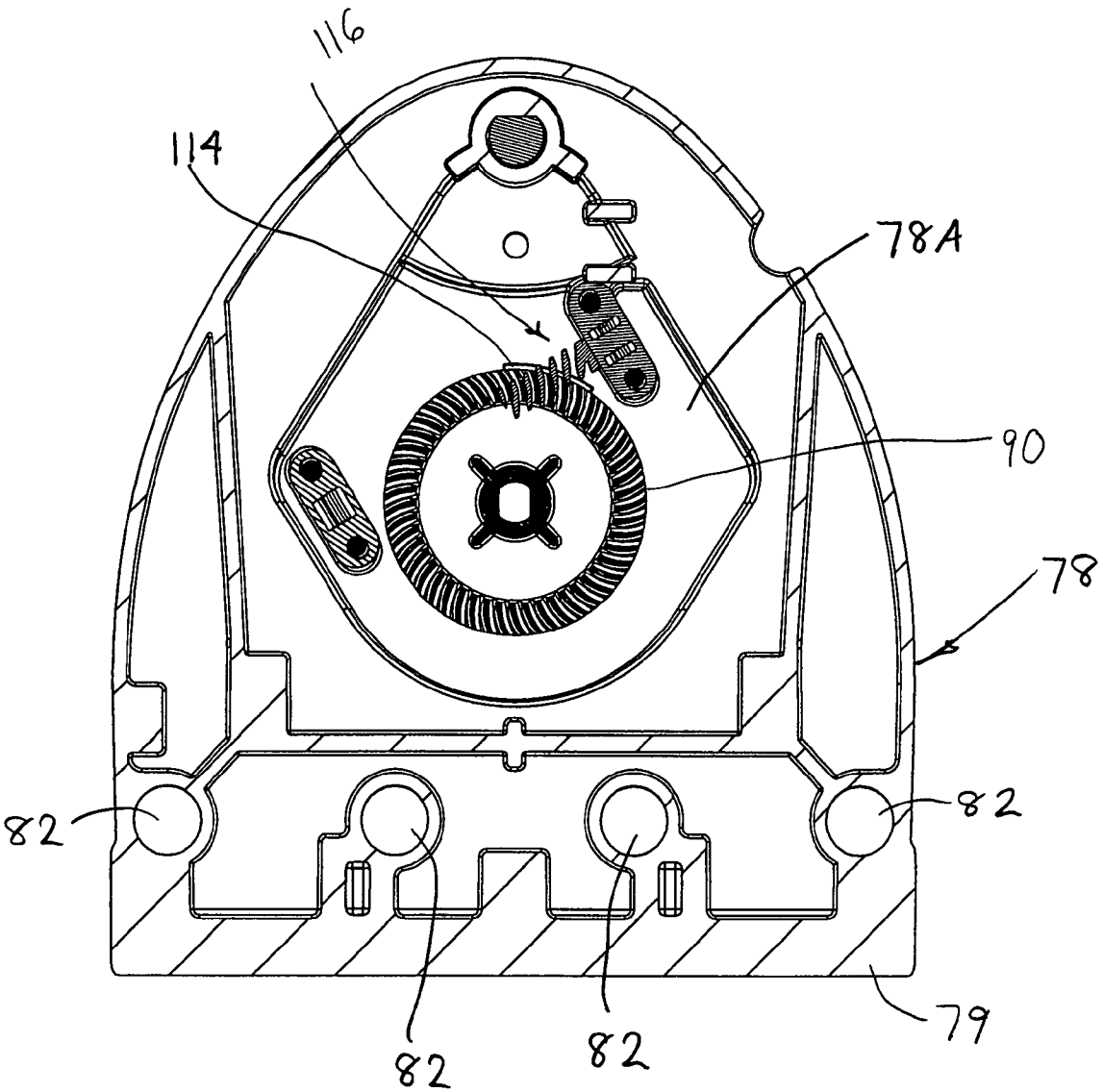
FIG. 12 is a bottom cross-sectional view as taken through the top plate.
Figure 13:
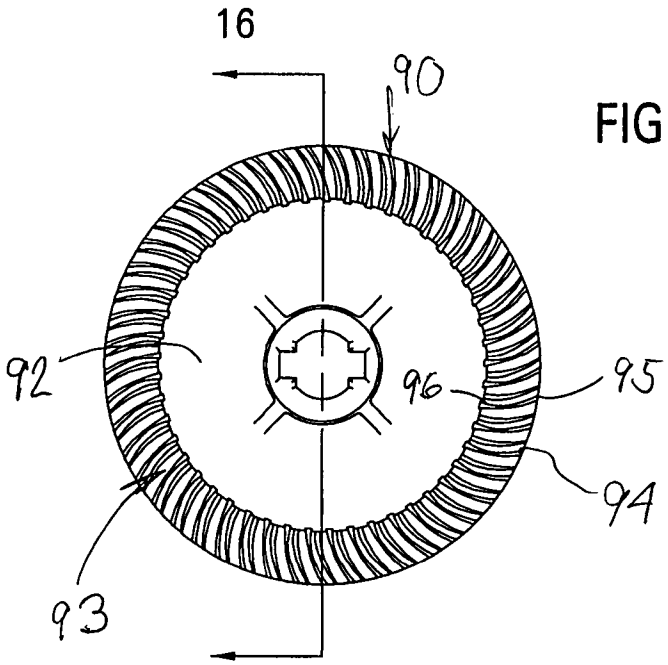
FIG. 13 is a bottom view of a face gear.
Figure 14:
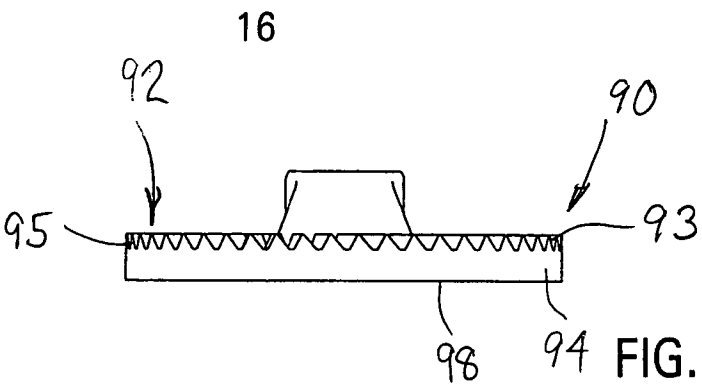
FIG. 14 is a side elevational view of the face gear.
Figure 15:
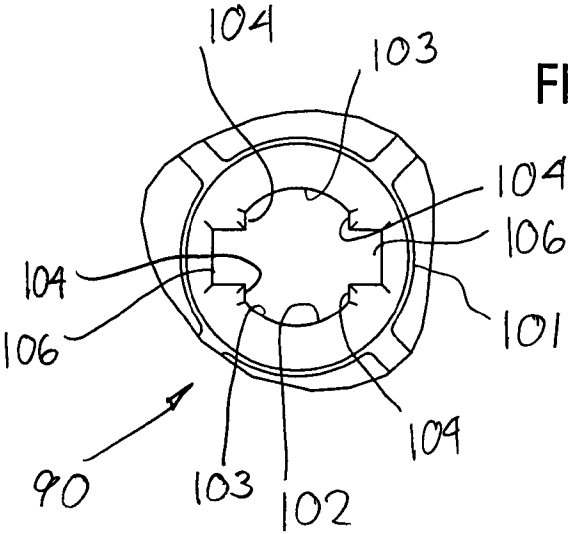
FIG. 15 is an enlarged bottom view of the mounting hub of the face gear.
Figure 16:
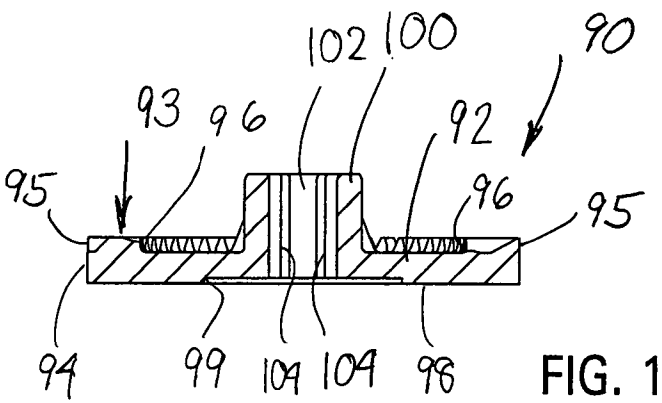
FIG. 16 is a side cross-sectional view of the face gear as taken along line 16-16 of FIG. 13.
Figure 18:
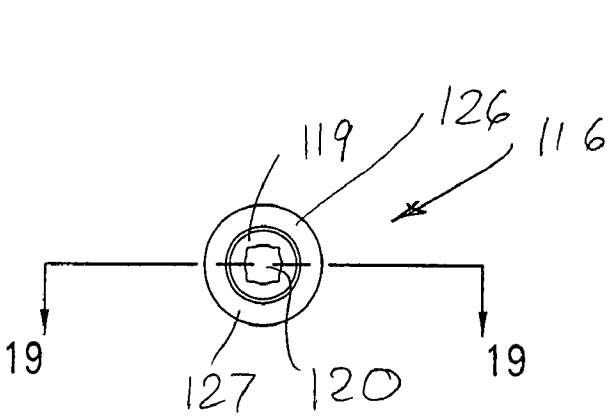
FIG. 18 is a left end view of the actuator shaft.
Figure 20:
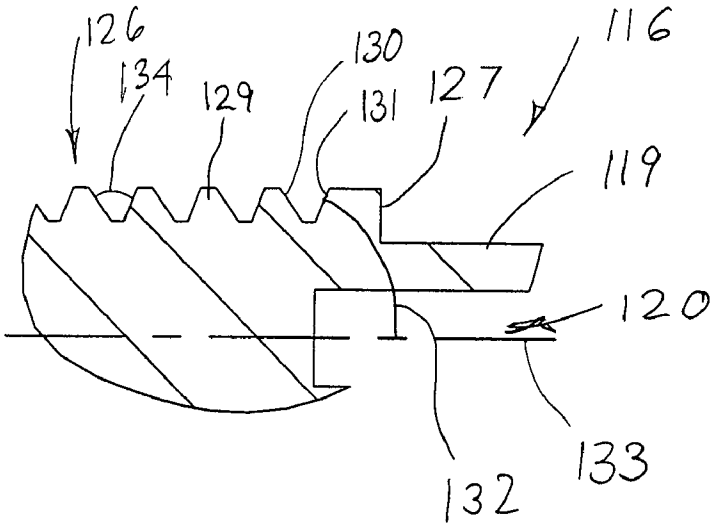
FIG. 20 is an enlarged partial cross-sectional view of a distal end of the actuator shaft.
Figure 17:
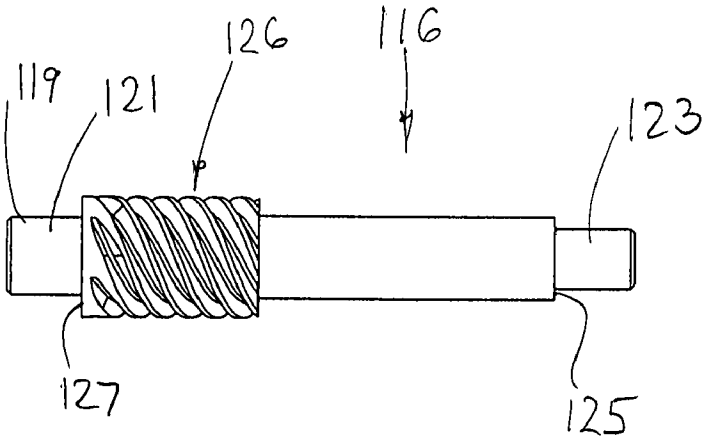
FIG. 17 is a plan view of an actuator shaft with a spiral pinion formed thereon.
Figure 19:
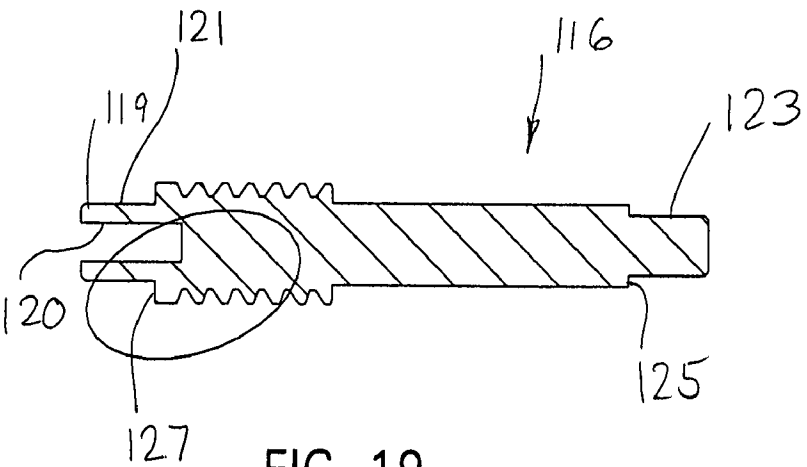
FIG. 19 is a cross-sectional view of the actuator shaft as viewed along line 19-19 of FIG. 18.

More particularly as to the threaded section 126, this section has spiral gear teeth 129 extending circumferentially around the entire circumference of the threaded section 126 which gear teeth 129 have a spiral shape and mate with the corresponding spiral gear teeth 93 formed on the gear 90. As to the formation of the individual gear teeth, these gear teeth 129 are formed by annular grooves extending about the circumference thereof with each groove defining opposed gear faces 130 and 131 as seen in FIG. 20. Each gear tooth l29 is formed at an angle 132 of 68.4 degrees relative to the center axis 133 of the gear section 116. The opposing tooth face 130 further is formed at an angle 134 (FIG. 20) of 56.5 degrees relative to the face 131. This formation of gear teeth and its cooperation with similarly formed gear teeth on the gear 90 results in close fitting engagement of the threaded section 126 with the gear teeth 93 as illustrated in FIG. 12. As a result of this engagement, the gear section 116 spans across a portion of the gear 90 and results in multiple gear teeth 93 being continuously engaged with corresponding tooth sections on the pinion gear section 116 which project upwardly in engagement therewith. This provides an improvement over other prior art drive arrangements including those possessing gears therein. In this regard, the spiral gear arrangement of the invention is intended to provide smoother operation with less tooth stress and loading while also providing reduced backlash. Further, the gear section 116 has a two-point bearing connection with the top plate 78 by the respective clamp brackets 122 and 124. Further, the driving forces between the pinion gear section 116 and the gear 90 are directed more circumferentially in a plane generally parallel to the gear face 92 while vertical tooth loads are supported by the bearing 114.

During assembly, the gear 90 is rotatably mounted on the top plate 78 by the bushing 108 and thereafter the actuator shaft 91 is rotatably mounted in place by the clamp brackets 122 and 124. It is noted that the isolator bearing 114 is located generally above the pinion gear section 116 to accommodate any vertically directed forces acting on the outer gear circumference 94 as a result of the meshing engagement of the gear teeth on the pinion gear section 116 with the spiral gear teeth 93.

The top plate assembly then is mounted in place on the control body 41 with the gear 90 being fitted downwardly onto the upper end 67 of the drive shaft 65. With this arrangement, during operation, the actuator shaft 91 is manually rotated to effect driven rotation of the shaft 65 and move the torsion bar drive arm 52 upwardly or downwardly.

The biasing mechanism 46 represents one arrangement for effecting biasing of the chair into its normal upright position. It will be recognized that other biasing mechanisms employing other types of spring devices such as coil springs are well known and hence could be usable with the chair of the present invention. For example, the legs of coil springs could cooperate with the follower nut 74 to adjust the deflection thereof and thereby adjust the restoring force.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a chair having a base and a seat-back arrangement connected to the base by a tilt control mechanism, said seat-back arrangement comprising a seat assembly and a back assembly which is connected to said tilt control mechanism so as to be tiltable relative to said seat assembly rearwardly from a normal position to a rearwardly tilted position relative to said seat assembly, said tilt control mechanism including a biasing arrangement which generates a restoring force which resists rearward tilting of said back assembly and biases said back assembly towards said normal position, comprising the improvement wherein said tilt control mechanism includes a tilt control housing and a tilt tension arrangement supported on said control housing, said tilt control mechanism comprising a biasing unit which generates said restoring force and comprises an adjustment member which is movable to adjust said restoring force, said tilt tension mechanism including a gear drive mechanism comprising a rotatable drive shaft supported on said control housing which cooperates with said adjustment member such that rotation of said drive shaft about a rotation axis effects movement of said adjustment member, a face gear connected to said drive shaft so as to be rotatable about said rotation axis wherein rotation of said face gear effects a corresponding rotation of said drive shaft, and an actuator shaft which extends sidewardly and is manually rotatable about an actuator axis and cooperates with said face gear such that rotation of said actuator shaft about said actuator axis effects rotation of said face gear, said face gear having said rotation axis, a bearing face and a gear face which is opposite said bearing face and projects radially outwardly from said rotation axis to define a face plane, said gear face having circumferentially adjacent gear teeth extending circumferentially along a gear circumference about said rotation axis which said gear teeth project vertically from said gear face in an engagement direction generally parallel to said rotation axis and transverse to said face plane so as to terminate in said face plane, said gear teeth having a spiral shape in a radial direction extending outwardly from the rotation axis, said actuator shaft including an axially-extending threaded section which overlies said face plane and extends axially along a chordal path that intersects said gear circumference at opposite chord ends thereof and is spaced radially from said rotation axis in non-intersecting relation therewith, said threaded section having spiral threads extending circumferentially thereabout which engage with said gear teeth of said face gear along a portion of said chordal path wherein said spiral threads of said actuator shaft engage a radial extent of each of a plurality of said teeth of said gear face in said face plane extending generally parallel to said gear face, said gear teeth of said face gear each have a radial length that extends parallel to said gear face in said face plane which is perpendicular to said rotation axis such that meshing engagement of a respective radial extent of engagement of said gear teeth and said spiral threads generates a driving force extending circumferentially along the face plane of said gear teeth and axially along said actuator axis to effect rotation of said face gear, said actuator shaft being rotatably supported on said control housing on opposite sides of said threaded section proximate said chord ends and said control housing defining a bearing surface contactingly supporting said bearing face directly opposite said threaded section.

2. The chair according to claim 1, wherein said gear teeth of said face gear and said spiral threads of said actuator shaft project toward each other in the engagement direction which is oriented parallel to said rotation axis.

3. The chair according to claim 2, wherein said gear teeth of said face gear project downwardly and meshed portions of said spiral threads of said actuator shaft project upwardly.

4. The chair according to claim 1, wherein said tilt control mechanism comprises a housing having a control body on which said biasing unit and said drive shaft are supported, said housing further including a separable top plate which is separable from said control body and overlies said control body, said top plate including said face gear and said actuator shaft mounted thereon in a sub-assembly which is mountable on said tilt control body.

5. The chair according to claim 4, wherein said face gear has a downward opening bore in which an upper end of said drive shaft is slidably received wherein said gear is non-rotatably connected to said drive shaft.

6. The chair according to claim 4, wherein said actuator shaft has axially spaced apart support sections disposed radially outside of said face gear beyond said opposite chord ends, said support sections being rotatably supported on said top plate with said face gear positioned between said top plate and said actuator shaft.

7. The chair according to claim 1, wherein said gear teeth of said face gear each have an outer end which is spaced radially outward of an inner end wherein each said outer end is offset circumferentially relative to said respective inner end to define a spiral shape for said gear tooth.

8. The chair according to claim 1, wherein a plurality of said gear teeth engage a respective plurality of engagement portions of said spiral threads wherein the radial extent of engagement between each said gear tooth and said respective engagement portion varies in radial length and radial position along said actuator axis.

9. In a chair having a base and a seat-back arrangement connected to said base by a tilt control mechanism, said tilt control mechanism comprising a housing supported on said base and a pivot member pivotally supported on said tilt control housing to permit a chair occupant within said seat-back arrangement to recline rearwardly, a biasing member being connected between said control housing and said pivot member to resist said reclining movement by a restoring force, said biasing member comprising an adjustment member which is movable to adjust said restoring force wherein said tilt tension mechanism includes a gear drive mechanism comprising a rotatable drive shaft which cooperates with said adjustment member such that rotation of said drive shaft effects movement of said adjustment member, said tilt tension mechanism further including a face gear drivingly connected to said drive shaft wherein rotation of said face gear effects rotation of said drive shaft, and an actuator shaft supported in said tilt control mechanism which extends sidewardly and includes an actuator which is exteriorly accessible to permit manual rotation of said actuator shaft and cooperating with said face gear wherein said rotation of said actuator shaft effects rotation of said face gear, said face gear including circumferentially adjacent gear teeth which extend circumferentially about a rotation axis of said face gear, and said actuator shaft including a threaded section with spiral threads which extend circumferentially thereabout and engage said gear teeth of said face gear proximate said outer circumference, said tilt control mechanism including a bearing abutting against a gear face of said face gear proximate said outer circumference to support tooth loads acting between said spiral threads and said gear teeth which are directed normal to said gear face.

10. A chair according to claim 9, wherein said tilt control mechanism includes a cover plate which is mounted to said control housing and includes an inside plate face which is substantially parallel to a bearing face of said face gear which is disposed in opposing relation therewith, said bearing being disposed between said plate face and said bearing face such that said plate supports said gear loads.

11. A chair according to claim 10, wherein said face gear is rotatably supported on said plate.

12. The chair according to claim 11, wherein said plate is removable from said control housing with said face gear and said bearing remaining connected thereto.

13. The chair according to claim 12, wherein said actuator shaft is rotatably supported on said plate and is removable therewith.

14. The chair according to claim 9, wherein said gear teeth on said face gear have a spiral shape in a radial direction extending outwardly from the rotation axis of said face gear.

15. The chair according to claim 14, wherein said spiral threads of said actuator shaft engage a plurality of said gear teeth of said face gear in a plane parallel to said bearing face.

16. The chair according to claim 9, wherein said plate includes support brackets disposed on opposite sides of said face gear which rotatably support axially spaced apart locations along said actuator shaft, said bearing being disposed axially between said support brackets.

17. In a chair having a base and a seat-back arrangement connected to said base by a tilt control mechanism, said tilt control mechanism comprising a housing supported on said base and a pivot member pivotally supported on said tilt control housing to permit a chair occupant within said seat-back arrangement to recline rearwardly, a biasing member being connected between said control housing and said pivot member to resist said reclining movement by a restoring force, said biasing member comprising an adjustment member which is movable to adjust said restoring force wherein said tilt tension mechanism includes a gear drive mechanism comprising a rotatable drive shaft which cooperates with said adjustment member such that rotation of said drive shaft effects movement of said adjustment member, said tilt tension mechanism further including a face gear drivingly connected to said drive shaft wherein rotation of said face gear effects rotation of said drive shaft, and an actuator shaft supported in said tilt control mechanism which extends sidewardly and includes an actuator which is exteriorly accessible to permit manual rotation of said actuator shaft and cooperating with said face gear wherein said rotation of said actuator shaft effects rotation of said face gear, said face gear including a gear face having circumferentially adjacent gear teeth which extend circumferentially about a rotation axis of said face gear, and said actuator shaft including a threaded section with spiral threads which extend circumferentially thereabout and engage said gear teeth of said face gear proximate said outer circumference, said tilt control mechanism further including a load support device contacting a bearing face of said face gear which is opposite said gear face, said load support device being disposed proximate said outer circumference to support tooth loads acting between said spiral threads and said gear teeth which are directed normal to said gear face.

18. A tilt control mechanism according to claim 17, wherein said tilt control mechanism includes a plate removably connected to said housing on which said face gear is rotatably supported.

19. The tilt control mechanism according to claim 18, wherein said load support device comprises a load bearing disposed between said bearing face and said plate proximate to the engagement of said actuator shaft with said face gear.

20. The tilt control mechanism according to claim 17, wherein said tilt control mechanism includes support structures which rotatably support said actuator shaft adjacent to said face gear, said support structures being disposed on opposite sides of said face gear with said threaded section disposed axially therebetween.

21. The tilt control mechanism according to claim 20, wherein said support structures are disposed on said plate such that said actuator shaft is supported thereon.

22. In a chair having a base and a seat-back arrangement connected to said base by a tilt control mechanism, said tilt control mechanism comprising a housing supported on said base and a pivot member pivotally supported on said tilt control housing to permit a chair occupant within said seat-back arrangement to recline rearwardly, a biasing member being connected between said control housing and said pivot member to resist said reclining movement by a restoring force, said biasing member comprising an adjustment member which is movable to adjust said restoring force wherein said tilt tension mechanism includes a gear drive mechanism comprising a rotatable drive shaft which cooperates with said adjustment member such that rotation of said drive shaft effects movement of said adjustment member, said tilt tension mechanism further including a face gear drivingly connected to said drive shaft wherein rotation of said face gear effects rotation of said drive shaft, and an actuator shaft supported in said tilt control mechanism which extends sidewardly and includes an actuator which is exteriorly accessible to permit manual rotation of said actuator shaft and cooperating with said face gear wherein said rotation of said actuator shaft effects rotation of said face gear, said face gear including circumferentially adjacent gear teeth which extend circumferentially about a rotation axis of said face gear, and said actuator shaft including a threaded section with threads which extend circumferentially thereabout and engage said gear teeth of said face gear proximate said outer circumference, said tilt control mechanism including a cover plate which is mounted to said control housing and includes an inside plate face which is substantially parallel to a bearing face of said face gear which is disposed in opposing relation therewith, said cover plate including a hub connector connected thereto which rotatably connects said face gear to said cover plate and defines a hub such that said face gear is rotatably supported on said cover plate for rotation about said hub; wherein a low-friction support member is held between said plate face and said bearing face by said hub connector, and said plate is removable from said control housing with said face gear and said support member remaining connected thereto.

23. The chair according to claim 22, wherein said actuator shaft is rotatably supported on said plate and is removable therewith.

24. The chair according to claim 22, wherein said cover plate includes support brackets disposed on opposite sides of said face gear which rotatably support axially spaced apart locations along said actuator shaft, said support member being a bearing disposed axially between said support brackets.

* * * * *